United States Patent [19]

Parker et al.

[11] Patent Number: 5,071,492

[45] Date of Patent: Dec. 10, 1991

[54] METHOD FOR REDUCING THE FATIGUE CRACK GROWTH RATE OF CRACKS IN THE ALUMINUM ALLOY FUSELAGE SKIN OF AN AIRCRAFT STRUCTURE

[75] Inventors: Earl R. Parker, Monte Sereno; William J. Parker, West Hills, both of Calif.

[73] Assignee: Parker Research Inc., San Mateo, Calif.

[21] Appl. No.: 452,552

[22] Filed: Dec. 19, 1989

[51] Int. Cl.[5] ..... C22F 1/04

[52] U.S. Cl. ..... 148/125; 148/13; 148/130

[58] Field of Search ..... 148/125, 130, 13

[56] References Cited

U.S. PATENT DOCUMENTS 4,842,655 6/1989 Porowski et al. ..... 148/130

*Primary Examiner*—R. Dean

*Assistant Examiner*—Robert R. Koehler

[57] ABSTRACT

A method and apparatus for reducing the fatigue crack growth rate of cracks in the aluminum alloy fuselage skin of aircraft structures. A fatigue crack is identified, the crack having a tip defining the direction of crack propagation. Temperature differentials are produced between a narrow strip of the skin and portions of the skin adjacent to this narrow strip. The narrow strip extends from the crack tip to a predetermined distance forward the crack tip. The temperature differentials produced between the narrow strip and adjacent unheated portions of the aircraft skin are sufficiently high so that the expansion due to heating causes plastic flow to occur in the heated strip. The plastic flow results in a residual tensile stress which acts in the direction of crack propagation when the system is returned to a normal service temperature. This residual tensile stress is of a sufficient magnitude to effectively retard the crack growth rate.

18 Claims, 3 Drawing Sheets

METHOD FOR REDUCING THE FATIGUE CRACK GROWTH RATE OF CRACKS IN THE ALUMINUM ALLOY FUSELAGE SKIN OF AN AIRCRAFT STRUCTURE

BACKGROUND OF THE INVENTION

1. Field of the Invention

This invention relates to methods and apparatus for reducing the rate at which fatigue cracks grow in structures and more particularly to a method and apparatus for reducing fatigue crack growth in an aluminum alloy aircraft structure.

2. Description of the Related Art

The aluminum alloy sheet materials used in aircraft structural components are subject to repeated loadings which, in some circumstances, cause cracks to form by the process of metal fatigue. Such cracks grow slowly with increasing time and service, finally reaching a critical length of crack that can cause rapid propagation and catastrophic failure of an aircraft. Load surges such as those that can occur because of turbulent air or impact on landing may have some influence on crack growth, but the main cause of continuing crack growth is the stress produced by pressurization of the aircraft at high altitude.

Government regulations call for the airlines to make regular inspections for the formation and growth of cracks by several means, such as by sight or use of electronic devices. As planes become older, for example after twenty years or more, the number of pressurization and depressurization cycles involved will have been sufficient to produce cracks that will continue to grow at ever increasing rates. These cracks can eventually cause sudden catastrophic failure of a critical part of the aircraft, and in some extreme cases can cause complete destruction of an airborne aircraft. Government regulations call for replacement of parts when an inspection shows that a crack or cracks have grown to what has been determined from experience to be a potentially dangerous length. At present, there is no known method for stopping crack growth or for significantly reducing the rate at which cracks grow.

The present invention provides a relatively simple and inexpensive means for greatly retarding crack growth rates, and in some cases, for actually stopping the growth of a crack in an aluminum alloy sheet material.

SUMMARY OF THE INVENTION

The present invention is a method and apparatus for reducing the fatigue crack growth rate of cracks in the aluminum alloy fuselage skin of an aircraft structure. The first step involves identifying a fatigue crack in the skin. The crack has a tip defining the direction of crack propagation. The second step involves producing temperature differentials between a narrow strip of the skin and portions of the skin adjacent to this narrow strip. The narrow strip extends from the crack tip to a predetermined distance forward the crack tip. The temperature differentials produced between the narrow strip and adjacent unheated portions of the aircraft skin are sufficiently high so that the expansion due to heating causes plastic flow to occur in the heated strip. The plastic flow results in a residual tensile stress which acts in the direction of propagation when the system is returned to a normal service temperature. This residual tensile stress is of a sufficient magnitude to effectively retard the crack growth rate.

BRIEF DESCRIPTION OF THE DRAWINGS

The same elements or parts throughout the figures are designated by the same reference characters.

DETAILED DESCRIPTION OF THE INVENTION

Figure 1:
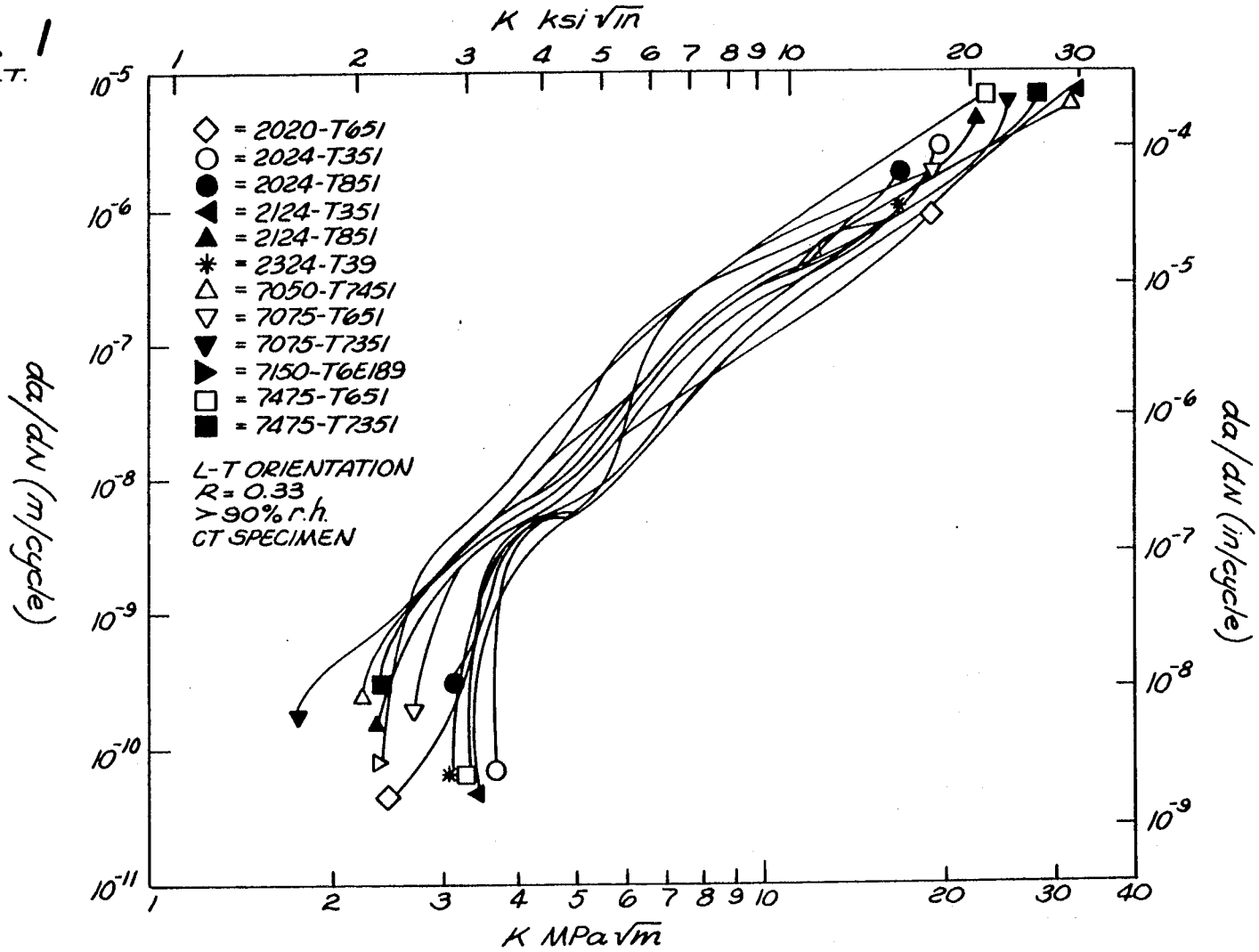
FIG. 1 PRIOR ART.
FIG. 1 contains curves of constant amplitude fatigue crack growth in aluminum alloys.
Figure 4:
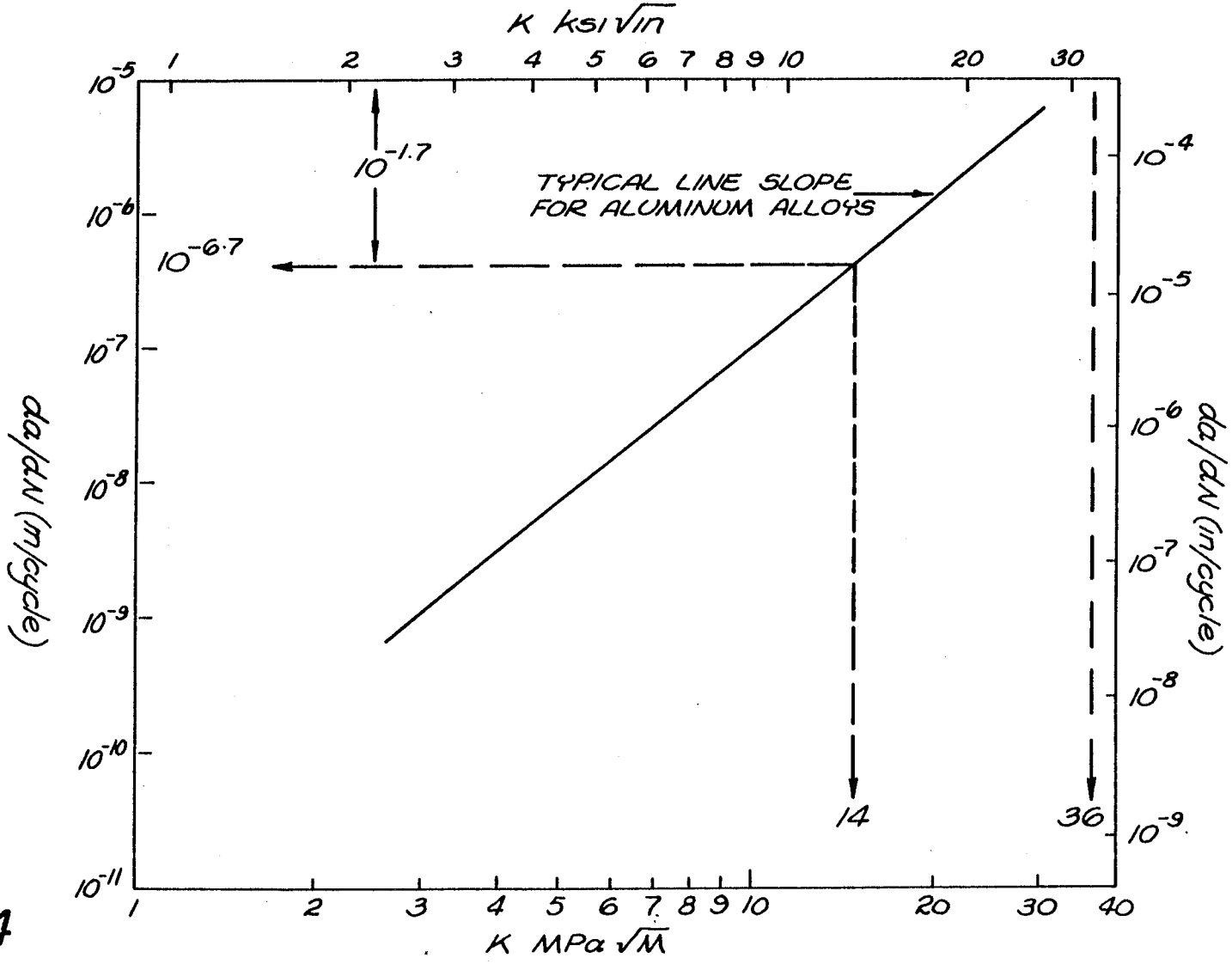
FIG. 4 is a typical line slope which has been generated from the family of fatigue crack growth curves illustrated in FIG. 1.

The following theoretical considerations are presented to provide the reader with a clear understanding of the principles embodying the present invention. The rate of crack growth may be specified by da/dN, which is the change in length, a, for a single cycle of load. A plot of da/dN vs. $\Delta K$ (the stress intensity range) is shown in FIG. 1, which is reproduced from MECHANICAL PROPERTIES AND PHASE TRANSFORMATIONS IN ENGINEERING MATERIALS—the Earl R. Parker Symposium on Structure-Property Relationships; 1986; FIG. 4; Page 276. The rate of crack growth with increasing $\Delta K$ is essentially linear on the log-log plot, except at very low and very high stress intensity levels, and the plots for all aluminum alloy sheet materials fall in a relatively narrow band. Note the important nature of the plot; a decrease in stress intensity from 10 to 5, for example, corresponds approximately to a tenfold decrease in the crack growth rate. Thus, if the stress intensity (due to a service load) at the tip of a crack in the skin of an airplane could be reduced by a factor of two, the growth rate of the crack would be reduced to one-tenth of the former rate.

Reducing the service load stress to one-half would produce this effect, but this is impossible to do. No practical means has heretofore been devised to drastically reduce crack growth rates in aircraft structures. The present invention provides a new method for altering the local stress state at the tip of a growing crack in such a way that crack propagation will be greatly minimized.

Figure 2:
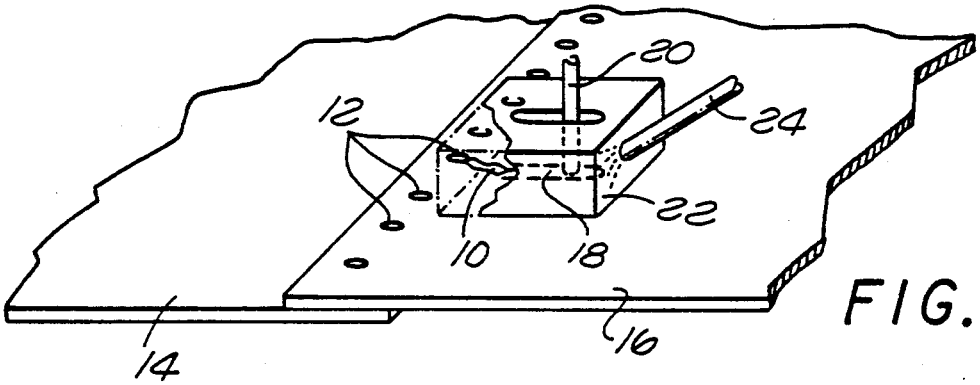
FIG. 2 is a schematic illustration of the apparatus of the present invention.

FIG. 2 illustrates a portion of the skin of the fuselage of an aircraft. Typically, a fatigue crack 10 originates at a rivet 12 interconnecting two sheets 14, 16 of aluminum alloy aircraft sheet material. Each sheet is typically 1/16 inch thick. Just forward the tip of the crack 10 there is a region in the metal that has undergone plastic flow because of the high stress concentration produced by the presence of the crack. The stress level at the outer boundary of the plastic zone is at the yield stress of the alloy. This stress level is, for example, two to three times the value of the nominal service stress that exists in the regions far removed from the tip of the crack. To retard crack growth, the effect of the high stress near the tip of the crack must be reduced by a significant amount. (Ideally, if a local residual longitudinal compressive stress, equal in magnitude to the yield strength could be introduced, the net stress would be zero and the crack would cease to grow. However, there seems to be no simple way to introduce such a residual compressive stress, so the solution to the problem of retarding crack growth must come from a different approach.)

The present invention entails the introduction of a width direction residual tensile stress which can be induced in the aluminum alloy sheet at and near the crack 10 and extends a significant distance in the uncracked sheet forward of the crack.

This successful solution of the problem is based on the microscopic nature of the crack growth process in aluminum and its alloys. Such materials do not fracture on the plane of maximum tensile stress. Rather, the local microscopic fracture path is on slip planes of the individual crystals that have slip planes on or near the microscopic plane of maximum shear stress, i.e. the planes at 45° angles to the direction of the load producing the stresses.

The reduction in the shear stress that causes a crack to grow can be accomplished by introducing a tensile stress acting in the direction that is at 90° to the line of the load stress. The method of the present invention provides a width direction residual tensile stress, $\sigma_W$. If the magnitude of the stress, $\sigma_W$, were equal to the magnitude of the longitudinal stress, the shear stress on the 45° planes on which the elements of the fracture surface lie would be zero and further crack growth could not occur. For some aluminum alloys (e.g. 2024) calculations indicate that some crack growth can actually be stopped. With the stronger alloys commonly used in aircraft structures completely stopping crack growth may not be possible; however, it is possible to reduce crack growth rates to one-tenth, or in some cases, to even one one-thousandth of the growth rate that prevailed before the width direction stress was introduced by application of the method constituting the present invention.

The method employed for producing the required width direction stress consists of heating a strategically located region or strip 18 of the sheet material to a high enough temperature to produce a temperature differential between the heated strip 18 and the sheet material surrounding the strip, which is highly restrained by the surrounding lower temperature region of the sheet, to cause the thermally expanding strip to flow plastically. The heat source 20 may be, for example, a laser. Or, a flame produced by a mixture of oxygen or air and a hyrdocarbon gas may be used. Another means of heating may include the use of a solid, constant temperature heat source in physical contact with the strip 18. The solid heat source may, for example, be copper. Since the heated strip 18 is restrained from expanding in the length direction by the adjacent colder regions and the volume has increased because of the thermal expansion, a compressive stress is generated in the heated strip.

The magnitude of the compressive stress increases with temperature differential between the hot and cold regions of the sheet. When the stress reaches the yield strength of the alloy, plastic flow occurs with an increase in temperature differential and the strip 18 of material becomes thicker (because the volume must increase with increasing temperature and the only direction free for expansion is the thickness direction). Since plastic flow produces a permanent change in sheet thickness, which tends to remain when the heated portion is cooled to the normal temperature of the entire sheet, the heated strip 18, if it were free from constraint, would be shorter at normal temperatures. However, the restraint imposed by the surrounding material forces the strip to exist at a longer dimension than it would be if the ends of the strip were free. Thus, the thickened strip 18 is forced to exist in a state with a residual tensile stress acting in the width direction.

Review of the mechanical properties of commonly used aluminum aircraft sheet materials, such as yield strength data compiled in ASM HANDBOOK VOL 2, 1979, indicated that if the surrounding lower temperature region of the sheet is at an ambient temperature (i.e., approx. 24° C.) then the temperature difference required between the heated and ambient temperature parts of the sheet would have to be so high that the 24° C. yield strength of the heated strip material would be lowered by exposure to the high temperature to an unacceptably low value. Thus, to prevent a significant loss of 24° C. yield strength, the temperature of the sheet material must be greatly lower than ambient temperature so that the desired temperature differential can be achieved without compromising yield strength.

In high strength aluminum alloy sheet material, the temperature differential between the heated strip and the neighboring material would have to be 350° C. to 400° C. to produce the magnitude of residual stress required to greatly retard the rate of growth of the fatigue crack.

Figure 3:
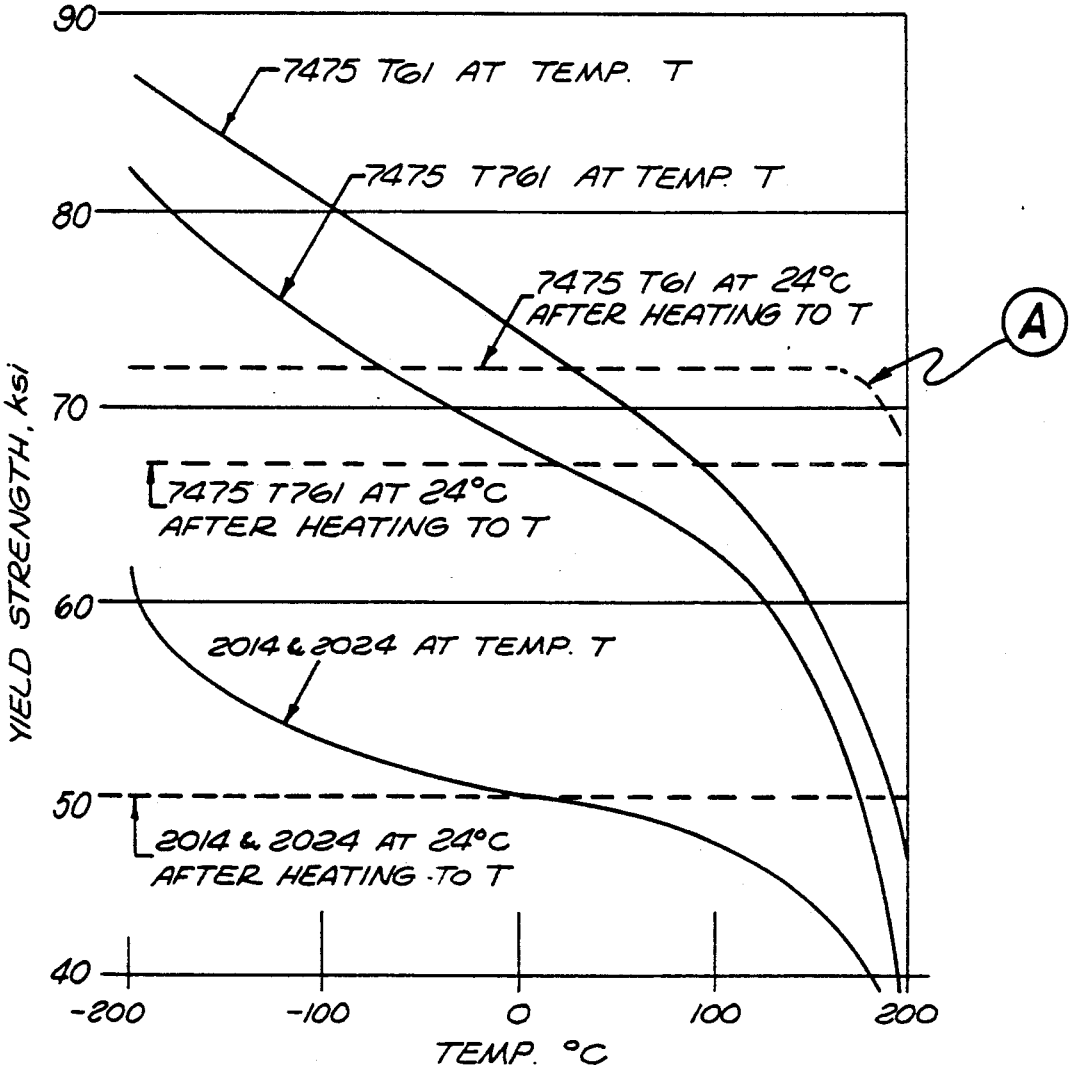
FIG. 3 PRIOR ART
FIG.3 illustrates plots of yield strength versus temperature for four aluminum alloys.

However, when such aluminum alloys are heated to temperatures exceeding about 200° C. annealing reactions occur within the alloys that cause the alloy to become permanently weakened. For example, referring to FIG. 3, which is a plot of yield strength vs. temperature, it can be seen that for 7475T61 aluminum alloy, which has the highest strength of the illustrated alloys, a permanent annealing or softening effect occurs after heating to approximately 170° C. (see curve A).

Therefore, for aluminum alloys having yield strengths greater than 50,000 psi, i.e., 7000 series alloys, to provide the required temperature differential without compromising yield strength the temperature should be lowered to approximately—200° C. before the strip is heated. Liquid nitrogen, having a temperature of −196° C., is an excellent candidate for providing such a cooling of the metal sheet. This permits the maximum temperature of the heated strip to be low enough so that the 24° C. yield strength is essentially unaffected but permits the temperature differential to be adequate to create the level of residual tensile stress necessary to greatly retard the crack growth rate.

By way of example, but not limitation, the region 18 being heated may be approximately ⅛ inch by 1 inch. The region 22 being cooled by source 24, may be, for example, 1 inch by 1 inch—the heated region 18 being preferably centered within the cold region 22. The optimum width of a particular heated zone should be determined by experiments on the actual aluminum alloy sheet material that is to be treated by the process or on a very similar alloy. It depends upon the sheet thickness, the rate of heating, and other factors. Test specimens should be subjected to cooling and heating cycles with different amounts of heat input to provide the basic data needed for analytical correlations to practical applications. Such experiments being readily conductible to those skilled in the art.

The following steps provide an example of a calculation of the residual width direction stress produced in 7475 T61 aluminum alloy, assuming that the temperature of the alloy is raised from the liquid nitrogen temperature (−196° C.) to 200° C. Further calculations are provided to evaluate the significance of this residual stress:

1. Elastic strain at 200° C. yield strength:

$$\epsilon_{Y200} = \sigma_{Y200}/E_{200}, \quad \text{where } E_{200} = 9.5 \times 10^6 \text{ (from literature)}, \quad \sigma_{Y200} = 48 \times 10^3 \text{ psi (from FIG. 3)}$$

$$= 5.1 \times 10^{-3} \text{ in/in}$$

2. Thermal expansion $\epsilon_{EXP}$ strain at 200° C.:

$$\epsilon_{EXP} = (\Delta T)\text{ (coefficient of expansion)}$$
$$= (196 + 200)(24 \times 10^{-6})$$
$$= 9.5 \times 10^{-3} \text{ in/in}$$

3. Equate $\epsilon_{EXP}$ to $(\epsilon_{Y200}+\epsilon_{P200})$, to solve for $\epsilon_{P200}$ (where $\epsilon_{P200}$ is the plastic irreversible strain).

$$\epsilon_{P200} = \epsilon_{EXP} - \epsilon_{Y200}$$
$$= 9.5 \times 10^{-3} - 5.1 \times 10^{-3}$$
$$= 4.4 \times 10^{-3} \text{ in/in}$$

4. Calculate $\sigma_W$ at 24° C. that $\epsilon_{P200}$ produces.

$$\sigma_{W24} = E_{24}\epsilon_{P200}$$
$$= (10 \times 10^6)(4.4 \times 10^{-3})$$
$$= 44 \text{ ksi}$$

Now that the residual width direction stress, $\sigma_{W24}$, has been determined, its significance may be evaluated.

The net shear stress, $\tau_{L24}-\tau_{W24}$, on the 45° plane, is equal to $(\sigma_{L24}-\sigma_{W24})/2$.

This is, in the present case, equal to 14 ksi.

A decrease in crack growth rate may be determined by reference to FIG. 1 which illustrates fatigue crack growth rate vs. stress intensity range, ΔK, where ΔK is directly proportional to the shear stress $(\sigma_L/2)$. For example, referring to FIG. 1, when ΔK=20, and we are located on a curve where fatigue growth rate da/dn=10 $^{-6}$, then if the value of ΔK is reduced by 50% to 10, then the crack growth rate on the same curve would be approximately $10^{-7}$. Thus, a reduction of a maximum shear stress, $\sigma_L/2$, by a width direction tensile stress equal to 50% of $\sigma_L$ reduces the crack growth rate, da/dn, by 10 $^{-1}$. Similarly, if $\tau_W$=75% of $\sigma_L/2$, the crack growth rate would be reduced by $10^{-3}$.

Referring now to FIG. 4, a typical line slope is illustrated which has been generated from the family of fatigue crack growth curves illustrated in FIG. 1. For the present example, i.e., $\beta T \approx 400°$ C., the net shear stress, $\tau_{L24}-\tau_{W24}$=14, is reduced from $\sigma_{L24}/2$=36. Therefore, as can be seen by reference to FIG. 4, the ratio of crack growth rate with a residual width direction tensile stress to the crack growth rate without the residual width direction tensile stress is $10^{-1.7}$. Thus, an extremely effective method is provided to retard the crack growth rate.

The table shown below tabulates the results of calculations made for various aluminum alloys and treatment temperatures. For example, the table illustrates that if the treatment temperature for 7475T61aluminum alloy is only 177° C. instead of 200° C. then the effectiveness of the treatment is lowered from a ratio of $10^{-1.8}$ to $10^{-1.0}$. (All cases assume that the alloy is pre-cooled to the liquid nitrogen temperature.)

TABLE 1

EFFECT OF RESIDUAL WIDTH DIRECTION STRESS ON THE CRACK GROWTH RATE AT 24° C.

| | Stresses in ksi | | | | | |
|---|---|---|---|---|---|---|
| T*°C. | $\sigma_{L24}$ | $\sigma_{W24}$ | $\tau_{L24}$ | $\tau_{W24}$ | $\tau_{L24-W24}$ | $(da/dn)_{L-W}/(da/dn)_L$ |
| 7465 T61 | | | | | | |
| 200 | 72 | 44 | 36 | 22 | 14 | $10^{-1.7}$ |
| 177 | 72 | 33 | 36 | 16 | 22 | $10^{-1.0}$ |
| 7475 T761 | | | | | | |
| 200 | 72 | 51 | 36 | 25 | 11 | $10^{-2.3}$ |
| 177 | 72 | 36 | 36 | 18 | 18 | $10^{-1.4}$ |
| 2014 & 2024 T3 | | | | | | |
| 200 | 50 | 51 | 25 | 25 | 0 | ZERO |
| 177 | 50 | 43 | 25 | 21 | 4 | $10^{-2}$ |

where

T* is the treatment temperature;

$\sigma_{L\,24}$ is the longitudinal tensile stress at 24° C.;

$\sigma_{W24}$ is the width direction tensile stress at 24°C.;

$\tau_{L24}$ is the component of shear stress on the planes at 45° due to the longitudinal tensile stress;

$\tau_{W24}$ is the component of shear stress on the planes at 45° due to the width direction tensile stress;

$(da/dn)_L$ is the rate of crack growth when the width direction tensile stress is zero; and $(da/dn)_{L-W}$ is the rate of crack growth when the shear stress on 45° due to the width direction tensile stress is subtracted from the shear stress on those planes due to the longitudinal tensile stress (the two shear stresses act in opposite directions on the 45° planes).

For aluminum alloys having yield strengths of approximately 50 ksi or less at 24° C. and approximately 20 ksi or less at 200° C., the principles of the present invention may be effectively implemented without the need for precooling. Heating the strip from 24° C. to 200° C. without precooling still results in a significant reduction in the crack growth rate. For example, if Alloys 2014 and 2024 T3 are heated to 200° C. without any precooling the yield strength of these alloys drops to such a low value (20 ksi) that enough plastic flow occurs that a substantial residual width direction stress at 24° C. exists. The residual width direction stress is sufficiently high that the resulting crack growth rate is reduced to one-eighth of the before treatment rate. (With the full treatment, i.e., treatment including precooling to −196° C., the crack growth rate is reduced to zero.) Thus, elimination of precooling simplifies the procedure and in a number of applications is an adequate and acceptable treatment.

The principles of the present invention may be implemented in a variety of ways. The heating element should be capable of being securely anchored over the crack tip area without damaging the material to which it is attached. For example, vacuum suction cups may be used such as those that are in common use to handle large pieces of glass and large mirrors.

The device should have edge seals at the junction between the material being treated and the bottom of the equipment housing the heating and cooling devices. The seals must be able to function effectively at −196° C. so that the escape of liquid nitrogen is minimized. For example, a rubbery plastic material may be utilized that remains rubbery at such a low temperature. Or, mechanically operated curtain materials may be utilized with springs that would force sections of the curtains down against the surface of the metal being treated.

Another desired design criterion is that the device should be capable of fitting tightly on complex curved surfaces. The above-described sealing techniques allow such an implementation.

Conventional means may be utilized to supply liquid nitrogen and deliver the exhausting nitrogen gas. Temperatures of the base sheet material may be monitored by the use of contact thermocouples to assure that the desired temperature differential is achieved.

As previously noted, laser heating is preferred to assure that the strip is heated rapidly and uniformly to the desired temperature with minimum spreading of heat into adjacent cold sheet material. However, other sources of heat can also be used such as, for example, a hot jet of gas such as that obtained from a burning flame generated by a mixture of air or oxygen mixed with a hydrocarbon gas. It is desirable, but not essential, that the heat source be such that it can be oscillated from one end of the strip to the other end and that it have a width equal to the width of the strip to be heated.

A conventional optical system for remote viewing is desirable to allow fine adjustments to be made for accurately positioning the heating beam in the proper location relative to the crack tip and the crack growth direction.

Additionally, a recording system capable of monitoring and recording all of the important variables such as time, location, temperatures, operator's identification, etc., should be provided.

Obviously, many modifications and variations of the present invention are possible in light of the above teachings. It is, therefore, to be understood that within the scope of the appended claims the invention may be practiced otherwise than as specifically described.

What is claimed and desired to be secured by Letters Patent of the United States is:

1. A method for reducing the fatigue crack growth rate of cracks in the aluminum alloy fuselage skin of an aircraft structure, comprising the steps of:

(a) identifying a fatigue crack in said skin, said crack having a tip defined in the direction of crack propagation;

(b) identifying a narrow strip of predetermined dimensions on said skin, said narrow strip extending on said skin from the crack tip to a predetermined distance forward the crack tip;

(c) cooling a section of said skin in the vicinity of said narrow strip to a predetermined temperature; and (d) heating said narrow strip, the temperature differential being produced between the heated strip and adjacent unheated portions of the skin being sufficiently high so that the expansion due to heating causes plastic flow to occur in the heated strip resulting in a residual tensile stress when the aircraft structure is at a normal ambient service temperature, said residual tensile stress acting in the direction of crack propagation at said normal service temperature and being of sufficient magnitude to effectively retard the crack growth rate.

2. The method of claim 1 wherein said step of heating said narrow strip includes heating said narrow strip to a temperature insufficient to substantially affect the ambient temperature yield strength of the skin.

3. The method of claim 2 wherein said step of cooling includes cooling to a temperature of approximately minus 196° C.

4. The method of claim 3 wherein said step of heating includes heating to approximately 200° C.

5. The method of claim 3 wherein said step of heating includes heating to an approximate range between 125° C. and 230° C.

6. The method of claim 2 wherein said step of heating includes heating with a laser.

7. The method of claim 2 wherein said step of heating includes oscillating a heat source from one end of said narrow strip to another end.

8. The method of claim 2 wherein said step of heating includes producing a temperature differential of approximately 400° C.

9. The method of claim 2 wherein said ambient temperature is approximately 24° C.

10. The method of claim 2 wherein said step of heating includes heating with a flame produced by a mixture of oxygen and a hydrocarbon gas.

11. The method of claim 2 wherein said step of heating includes providing contact of said narrow strip with a solid, constant temperature heat source.

12. The method of claim 11 wherein contact is provided with a copper heat source.

13. The method of claim 1 wherein said step of heating a narrow strip includes heating a narrow strip having the approximate dimensions of ⅛ inch by 1 inch.

14. The method of claim 1 wherein said step of cooling said section of said skin in the vicinity of said narrow strip includes cooling a portion having approximately a 1 square inch area defined so that said narrow strip is substantially centered within said section.

15. A method for reducing the fatigue crack growth rate of the aluminum alloy fuselage skin of an aircraft structure, said skin having a yield strength of approximately 50 ksi or less at an ambient service temperature of approximately 24° and a yield strength of approximately 20 ksi or less at 200° C., comprising the steps of:

(a) identifying a fatigue crack in said skin, said crack having a tip defining the direction of crack propagation;

(b) pre-cooling a section of said skin in the vicinity of said narrow strip to approximately −200° C.; and (c) heating a narrow strip of said skin, said narrow strip extending on said skin from the crack tip to a predetermined distance forward the crack tip, the dimensions of the strip and the magnitude of the temperature differential produced between the heated strip and adjacent unheated portions of the aircraft structure being sufficiently high so that the expansion due to heating is sufficient to cause plastic flow to occur in the heated strip resulting in a residual tensile stress when the aircraft structure is at said ambient service temperature, said residual tensile stress acting in the direction of propagation at said ambient service temperature and being of sufficient magnitude to effectively retard the crack growth rate.

16. The method of claim 15 wherein said fatigue crack is identified in a 2000 series aluminum alloy.

17. The method of claim 16 wherein said step of heating includes heating to approximately 200° C.

18. The method of claim 15 wherein said fatigue crack is identified in a 7000 series aluminum alloy.

* * * * *